United States Patent [19]

Adcock

[11] 4,415,047

[45] Nov. 15, 1983

[54] DOWNHOLE CASE DRIVING APPARATUS FOR IMPACT DRILLS

[76] Inventor: Gerald L. Adcock, 2033 3rd Ave. North, Lewiston, Id. 83501

[21] Appl. No.: 210,122

[22] Filed: Nov. 24, 1980

[51] Int. Cl.[3] ..... E21B 17/14

[52] U.S. Cl. ..... 175/305; 175/321

[58] Field of Search ..... 166/178; 175/171, 293, 175/294, 301, 305, 306, 321, 402, 83, 261

[56] References Cited

U.S. PATENT DOCUMENTS

| | | | |
|---|---|---|---|
| 1,774,884 | 9/1930 | Hansen | 175/171 |
| 1,908,217 | 5/1933 | Blumenthal | 405/280 |
| 2,538,690 | 1/1951 | Johnston | 175/294 |
| 2,821,363 | 1/1958 | Van Note, Jr. | 175/295 |
| 2,950,087 | 8/1960 | Gregory | 175/171 |
| 3,005,504 | 10/1961 | Mayhew, Jr. | 175/173 X |
| 3,190,378 | 6/1965 | Davey, Sr. et al. | 175/257 |
| 3,227,230 | 1/1966 | Lagerstrom | 175/306 X |
| 3,390,730 | 7/1968 | Techy et al. | 175/171 |
| 3,682,260 | 8/1972 | Klemm | 172/257 |
| 3,901,331 | 8/1975 | Djurovic | 175/173 |

*Primary Examiner*—Ramon S. Britts
*Assistant Examiner*—Joseph Falk
*Attorney, Agent, or Firm*—Wells, St. John & Roberts

[57] ABSTRACT

An apparatus is described for forceably pulling a well casing down into a drilled hole from the casing bottom end during a percussion drilling procedure, through use of the percussion drill tool. An anvil is fixed to the casing and projects inwardly to coact with the hammer surface on a precussion bit. The bit includes an interlock feature that allows selective disengagement with the anvil and allows the bit to be lowered past the anvil for drilling purposes. The anvil is situated above the drive shoe along a lower casing section. The lower casing section acts as a material accumulator, cooperating with the drilling bit and anvil shoulder to seal drilled areas and facilitate removal of drilled material from the drilled hole.

10 Claims, 12 Drawing Figures

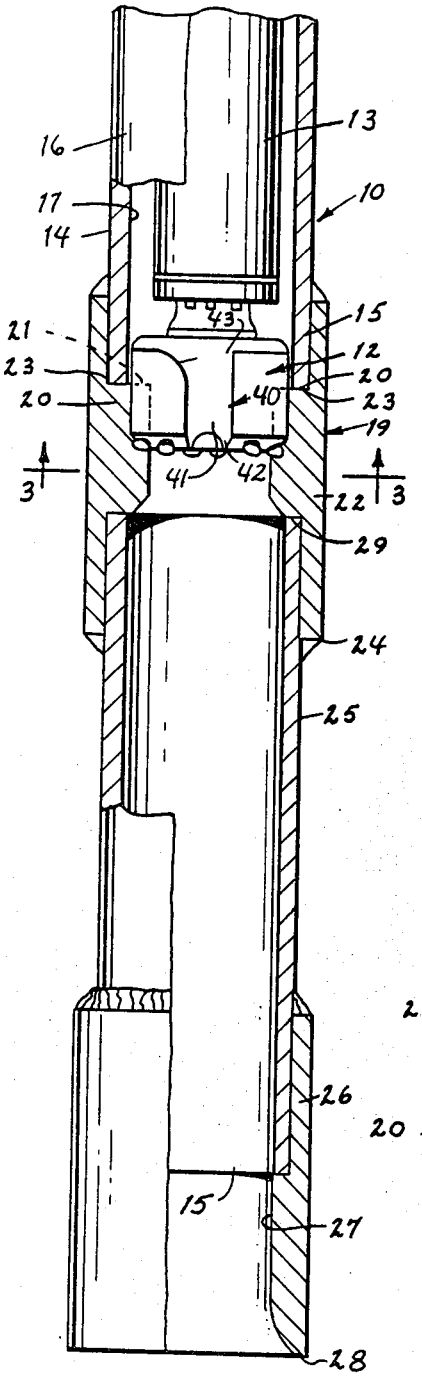
FIG 1
FIG 2
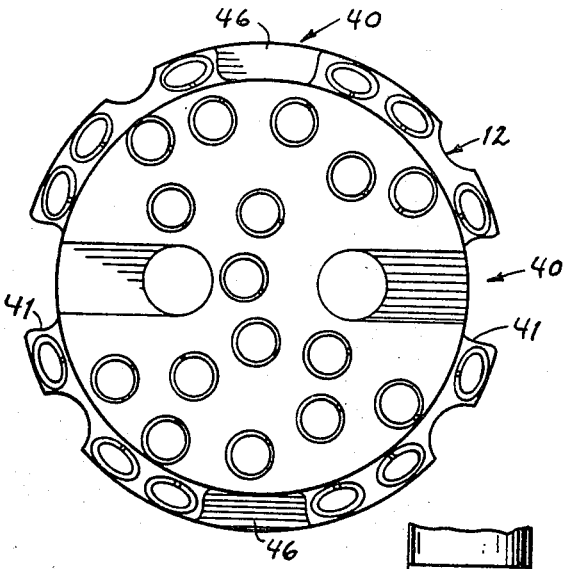
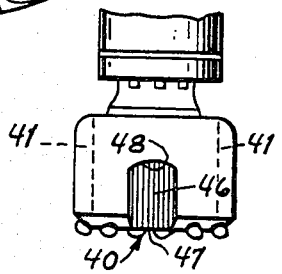
FIG 4
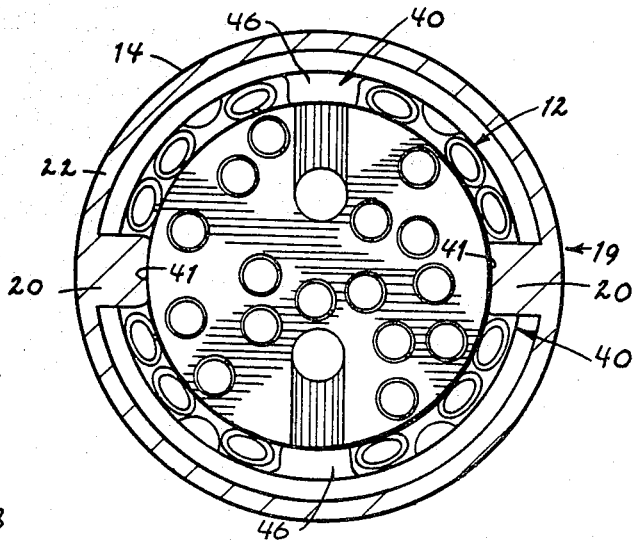
FIG 3

DOWNHOLE CASE DRIVING APPARATUS FOR IMPACT DRILLS

TECHNICAL FIELD

The present invention relates to well casing driving apparatus that is used to pull drill pipe casing down a bore hole from the bottom rather than pushing the casing downward from the top.

BACKGROUND

Most present day drilling rigs use the same basic approach for sinking well casings down the drilled hole. Sections of the casing are fitted together at the ground surface and then driven at the top of the drill hole downwardly into the hole as the drilling progresses. Different methods are used for driving the casing but the basic driving technique at the top of the drill hole remains the same.

Placing a long string of well casing sections under high compressional forces has several drawbacks. Frictional resistance to downward movement increases as the hole depth increases, therefore correspondingly increasing the requirements for casing driving forces. Long drill strings have a tendency to buckle similar to a long column under compression. The surrounding earth prevents such buckling at the cost of increased friction against the sides of the drilled hole. A casing driven from the top of the hole will normally follow the drilled hole but not with a desirable degree of accuracy, especially in soft ground. Section welds can easily become damaged, due to constant lateral shifting (partial buckling), when under compressive forces from above.

The above problems are recognized to a limited degree by Davey, Sr., et al, U.S. Pat. No. 3,190,378 granted June 22, 1965. The Davey, Sr. case driving mechanism makes use of apparatus for drilling and for pulling casing downwardly into a drilled hole. A rotary drill bit is releasably connected to a casing shoe mounted to the bottom of the casing. As the rotary drill bit rotates, L-shaped brackets on the rotary drill bit engage dogs projecting inwardly from the casing shoe. The casing shoe is rotatably mounted to the bottom of the casing and rotates with the rotary drill bit. The rotary drill bit rotates the casing shoe and additionally pulls the casing downwardly as the drilling progresses. At the end of the drilling operation, the drill tool is rotated in an opposite rotational direction to disengage the rotary drill bit and the inverted L-shaped brackets from the dogs, thus enabling the retraction of the rotary drill bit and the drill string up through the casing.

A cutting shoe of the Davey, Sr. equipment is extremely expensive. The shoe must have specially hardened and formed drill teeth at lower ends and appropriate sealed bearings at upward ends where the shoe is connected to the casing bottom to enable the shoe to rotate and perform part of the drilling function. The cutting shoe serves as a secondary bit which is left in the hole. Should the bearing fail or freeze, the shoe will twist the casing as the rotating bit rotates. Such a failure would require the entire string to be removed from the drilled hole for repair.

A further disadvantage of the Davey, Sr. device is the difficulty of flushing the drilled earth material from the hole since the flushing fluid has a tendency to migrate into the surrounding earth or up the outside of the casing without removing the drilled material up the inside of the casing.

A pile driving device is shown in the Blumenthal U.S. Pat. No. 1,908,217 granted May 9, 1933 wherein a drive point is hammered into the ground by a downhole pile driver. The pile shell is pulled downwardly by the downhole pile driver. The Blumenthal device is used exclusively for driving pilings and does not suggest use in a drilling operation in which earth material is to be removed from the hole. Blumenthal, however, exemplifies the desirability for downhole "driving" of a piling shell to prevent compressive damage of the piling shell and to decrease the force required to move the piing shell down the hole.

The present invention overcomes many of the problems of the prior art device and greatly increases the efficiency of drilling and driving casing into a bore hole.

BRIEF DESCRIPTION OF THE DRAWINGS

Preferred forms of the present invention are shown in the accompanying drawings in which:

FIG. 1 is a fragmentary view of the present apparatus in a well casing;

FIG. 2 is an enlarged bottom plan view of the bit used with the present apparatus;

FIG. 3 is an enlarged sectional view taken along line 3—3 in FIG. 1;

FIG. 4 is a fragmentary side view of the present bit;

DETAILED DESCRIPTION OF THE PREFERRED EMBODIMENTS

Figure 5:
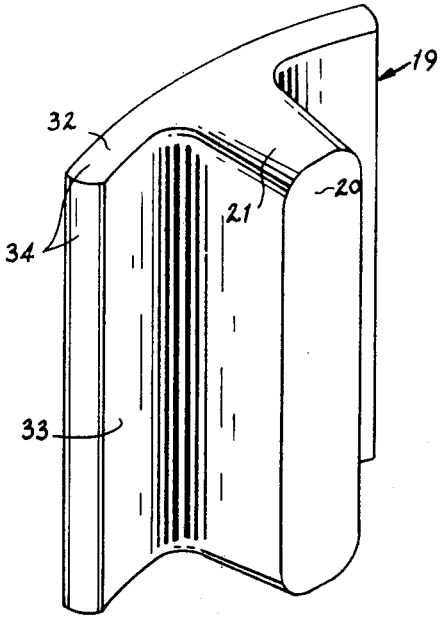
FIG. 5 is a pictorial view of an alternate form of an anvil shoulder spline used with the present apparatus.

The present apparatus, shown at 10 in the drawings, is intended for use with impact type drilling machines whereby a drilled hole 11 (FIGS. 9–12) is formed by a percussion drill bit means 12 at the end of a drill string (not shown). An impact percussion tool 13 is situated immediately above the bit at the bottom end of the drill string to impart a hammering motion to the bit. The present apparatus combines functions of the drilling bit and associated hammering device along with desirable features of a downhole case driving mechanism previously unavailable with such equipment.

The typical bore hole 11 (FIGS. 9 through 12) is lined with a cylindrical casing 14 extending down the hole to a bottom casing end 15. The casing is tubular, having a typical cylidrical outer surface 16 and concentric inside surface 17. Casing 14 is typically formed of metal pipe in long sections that are welded end-to-end as they are being lowered down the borehole 11. The present assembly serves to drive the casing down the bore hole from a position adjacent the bottom casing end 15.

The present assembly 10 is comprised of two basic parts that interact with the drill string and casing. First in a unique bit means 12. The bit means 12 operates in conjunction with an anvil on the casing to transmit hammering forces of the bit that are conventionally reserved for drilling to pull the casing down the hole.

The bit 12 and anvil 19 therefore allow downhole driving of the casing.

There are two forms of the anvil 19 shown in the drawings. The first form is shown in FIGS. 1 and 3 while the second form is shown in FIGS. 5 through 8. Generally the function of both forms is to present an anvil member 20 that projects into the casing with an upwardly facing anvil surface 21 for selective engagement with a complementary surface along the bit means 12.

The anvil 19 shown in FIGS. 1 and 3 is formed as part of an open cylindrical sleeve 22. The sleeve coaxially receives the casing. The sleeve includes a circular ledge surface 23 that is recessed into the bore of the sleeve to abut coaxially against an upper section of the casing 25. The sleeve extends downwardly from the ledge surface 23 to an open downward end 24.

A second ledge surface 29 is recessed upwardly from the end 24 to receive a lower section of the casing 25 that extends downwardly from the anvil 19 to the casing bottom end 15. The length of the lower casing section 25 is preferably in the neighborhood of two to three feet to operate as a material accumulator to facilitate removal of drilled material from the hole bottom. The length of section 25 may vary with the type of drilling equipment being used or other variables such as soil condition.

A tubular drive shoe 26 is rigidly mounted to the bottom end of the lower casing section 25. The shoe 26 therefore is directly attached to the sleeve 22 through the rigid lower casing section 25 and forces are transmitted directly from the sleeve to the shoe.

The tubular drive shoe 26 includes an open cylindrical bore 27 that is coaxial with the casing section 25. The bore is of similar or slightly larger diameter than the casing bore in order to permit free vertical passage of the bit means 12. A circular driving edge 28 is provided at the bottom end of the drive shoe 26 to facilitate movement of the shoe and attached casing section 25 through the earth.

The anvil members 20 have anvil surfaces 21 extending radially into the casing interior at diametrically opposed positions thereon for working engagement by the bit means 12. The anvil members 20 have a substantial axial thickness for the purpose of transmitting impact energy to the casing. Also, the anvil surfaces 21 are rounded to prevent formation of stress concentrations along the anvil 19 and to uniformly transmit impact forces received from the bit means.

A second form of anvil 19 is shown in FIGS. 5 through 8. In FIGS. 5–8 the anvil 19 is substantially T-shaped in cross section, having a transverse cross member 32 joining the anvil member 20. The cross members are arcuate, each having a concave inwardly facing surface 33 that is complementary to the exterior curvature of the cylindrical casing.

The second form of anvil 19 as shown in FIGS. 6 and 9 through 12 is provided to mount directly to the casing at a location spaced above the bottom ends 15. The lower casing section 25, in this embodiment, is integral with the remaining casing and is defined by the vertical distance from the casing bottom 15 to the anvil 19.

Figure 7:
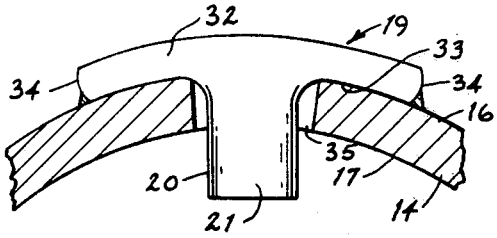
FIG. 7 is an enlarged fragmentary sectional view showing the alternate anvil shoulder mounted to the casing.
Figure 6:
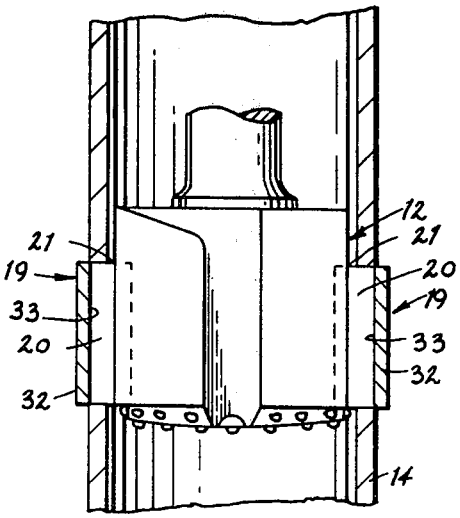
FIG. 6 is a fragmentary sectional view of the present bit and alternate form of anvil shoulder.
Figure 8:
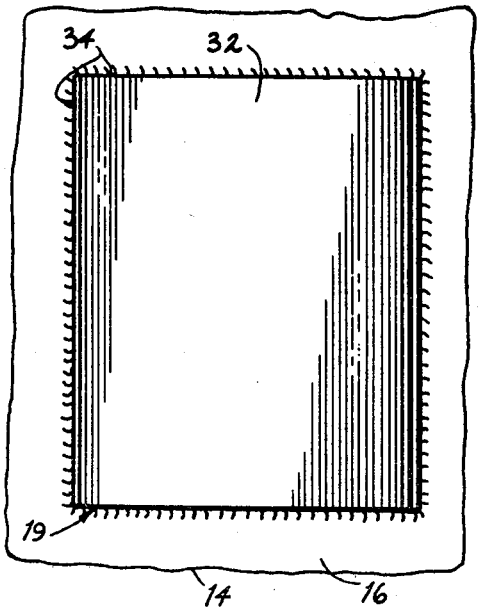
FIG. 8 is a back side view of the alternate anvil shoulder on a casing.

The anvil member 20, in the latter form, is adapted to extend through appropriate apertures 35 (FIG. 7) formed through the casing wall. The apertures 35 are preferably somewhat larger than the similar dimensions of the anvil members 20 to allow free access to the casing interior and to prevent stress concentrations along the points of contact between the casing and anvil members. The anvil 19 as shown in FIGS. 5, 7 and 8 include peripheral edges 34 about the cross member 32 to facilitate welding to an outer casing surface 16. The weld will secure the anvil shoulder to the casing and further aids to distribute impact forces across a wide section of the casing body.

When the anvil 19 of the second form is used, as discussed above, the length of casing between the anvil 19 and casing shoe serves as the lower casing section 25. The integral lower casing section 25 of the second form corresponds directly to the configuration shown in the first form in FIGS. 1 and 3. The distance, therefore, from the anvil 19 to the casing bottom end 15 remains similar in both forms.

Figures 9, 10, 11, 12:
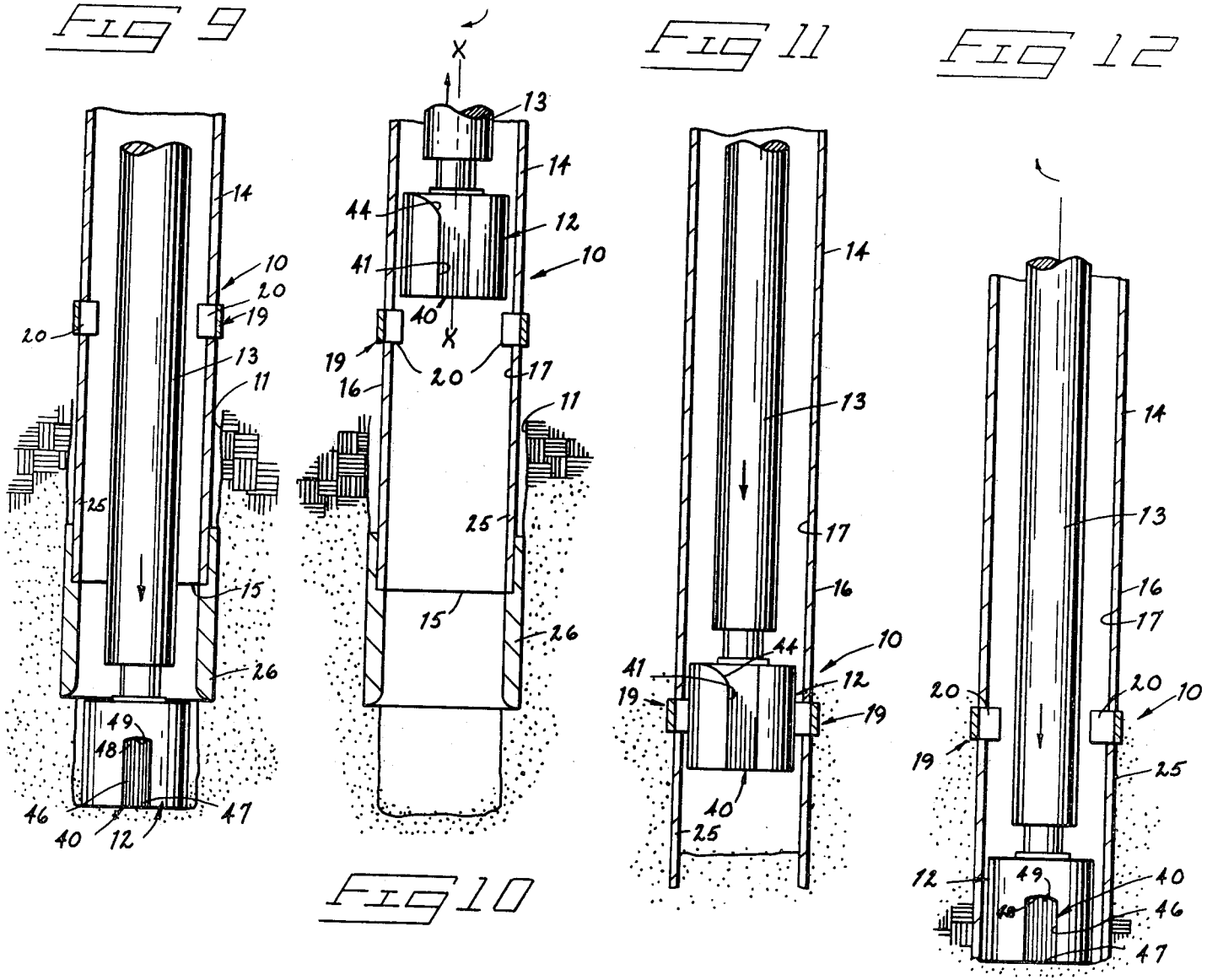
FIGS. 9 through 12 are diagrammatic views showing operation of the present apparatus.

FIGS. 1 through 4 and 6 illustrate the present bit means 12. The bit means 12 is comprised of an impact bit constructed with a lockout means 40 enabling selective engagement and disengagement with the anvil member 20. The bit 12 is therefore useful both in drilling purposes as shown in FIGS. 9 and 12 and for driving the casing downwardly as shown in FIGS. 10 and 11.

The lockout means 40 is comprised of through or open channels 41 and angularly spaced upright closed slots 46. The through channels 41 include open bottom and top ends 42 and 43 respectively (FIG. 1). The ends are axially aligned and the channels are shaped in cross section complementary to the shape of the projecting anvil members 20. The channels 41 slidably receive the anvil members 20 to allow movement of the bit in either direction past the anvil member 19.

An arcuate surface 44 leads into the top end 43 of each channel 41. The arcuate surface 44 serves as a guide means for aligning the channels 41 and anvil members 20 when it is desired to lift the bit means elevationally above the anvil members 20. The bottom surfaces of the anvil members may slide against the arcuate surfaces 44 and direct rotation of the bit means into proper alignment with the stationary anvil members 20.

The upright slots 46 are angularly spaced about the bit means from the open channels 41. The slots 41 each include an open bottom end 47 (FIGS. 9 and 12) leading upwardly to a closed top end 49. The closed slot ends 49 define slightly arcuate hammer surfaces 48. The hammer surfaces are complementary to the anvil surfaces 21 of the anvil members 20. The slots, likewise, are complementary to and slightly larger than the portions of the anvil members 20 that project into the casing.

The bit means 12, when lifted above the anvil shoulder 19 can be turned approximately 90° to align the upright slots 46 with the anvil members 20. The bit 12 can then be lowered to engage the anvil members 20 within the slots 46 until the hammer surfaces 48 engage the anvil surfaces 21 (FIGS. 1–11). The hammer device can then be actuated, causing hammer surfaces 48 of the bit means to impact against the anvil members 20. The downwardly driving force is transmitted through the anvil members to pull the casing 16 downwardly into the drilled hole.

The process of drilling and case lining that is facilitated by the present apparatus begins with assembly of the first length of casing. With the form shown in FIG. 1, the sleeve shaped anvil 19 is attached to the casing by welding or other appropriate fastening means and the short, lower casing section 25 is similarly attached to the sleeve bottom. Similarly, the tubular drive shoe 26 may be affixed to the bottom end of the lower section 25.

If the second form of anvil shoulder is to be used, two diametrically opposed apertures 35 are formed in the first length of casing at a prescribed distance above the casing bottom. The distance defines the length of casing used as the lower casing section 25. The apertures may be formed by drilling or with a cutting torch. The T-shaped anvils 19 are then inserted and welded into position.

The remaining steps involved in the drilling and case lining process are the same for both forms of anvil arrangements and will be discussed as if either were being used.

The present bit means 12 is attached to the pneumatic impact tool 13 and the accompanying drill string is inserted into the casing. The drill bit means 12 is turned as it descends to the anvil shoulder 19, aligning the upright channels 41 with the inwardly projecting anvil members 20. The bit means 12 is lowered past the anvil members 20. The bit means is lowered to the ground surface and drilling is commenced with actuation of the pneumatic impact tool 13 as illustrated in FIG. 9.

Drilling is accomplished in a succession of steps as shown in FIGS. 9 through 12. The bit means is driven to a prescribed depth below the shoe 27 (FIG. 9). In relatively soft soil, the compressed air that typically flushes the drilled material up through the drill casing to the surface dissipates into the loose surrounding strata or up the outside of the casing 14. Thus, not all material is driven up the interior of the casing and some settles on the top surface of the bit means and partially refills the drilled hole when the bit is retracted.

After drilling a specified distance, the bit means 12 is lifted into engagement with the anvil members 20. The drill string is rotated, bringing the anvil members 20 into engagement with the arcuate anvil surfaces 44. These surfaces 44 lead to the upright channels 41 which allow free upward passage of the bit means 12 to an elevation above the anvil members 20 (FIG. 10). The bit means is then rotated 90° and lowered to align the upright slots 46 with the anvil members 20. The anvil members are received within the slots and the hammer surfaces 48 are lowered into engagement with the anvil surfaces 21.

The pneumatic impact tool 13 is again actuated and the casing 14 is driven from its bottom end down into the drilled hole. The lower casing section 25 is thus pushed downward into the drilled hole and through the loose already drilled material as illustrated in FIG. 11 to surround the loose material and seal it from the surrounding strata.

The casing 16 is driven downwardly to the bottom of the hole. At this point, the bit means 12 is lifted to disengage the upright slots 46 from the anvil members. The bit is then rotated 90° to bring the upright channels 41 into alignment with the anvil members 20. The bit means 12 is then lowered past the anvil shoulders to engage the loose material and flush the loose material from the lower casing section 25 until the bit means 12 reaches the bottom edge of the shoe 26. Since the loose material is confined within the lower casing section 25, the flushing air efficiently drives the loose material up the interior of the casing to quickly cleanse the bottom of the hole. The bit means 12 then continues downward beyond the shoe 26 to drill and loosen additional material, extending the depth of the hole.

The above steps are repeated successively, (deepening the hole and then pulling the casing downward toward the hole bottom) until the drilled hole is completed to the desired depth. Successive lengths of drill string are added as the hole deepens and successive lengths of casing are similarly added. The casing sections are welded end to end to provide a continuous casing length from the top to the bottom of the hole.

Distinct advantages are gained by use of the present apparatus over prior forms of above ground case driving apparatus. By pulling the casing downwardly from the bottom of the drilled hole, a straighter path for the casing is made. The high degree of accuracy is maintained as the casing seeks to plumb itself from the bottom up, due to the applied tension. The pulling force automatically places the entire casing length and tension, decreasing the force normally required to move the casing downward into the drilled hole. Experimentation has indicated that a reduction of about one third in the power requirement is involved when the casing is pulled from the hole bottom. The power requirement is reduced due to the fact that the impact energy is concentrated at the bottom of the hole where the driving force requirement is highest.

With typical top hole driving techniques, the energy is imparted at the top of the casing and is dissipated by frictional engagement with the drill hole walls as the force of impact moves down the length of the casing. The welds along the length of the assembled casing are subjected to uniform tension and thus are not subjected to bending or buckling stresses that are normally involved in top hole case driving. The welds are therefore more likely to hold. An additional advantageous feature is the rapid transition allowed from drilling to driving of the casing.

The present apparatus also has distinct advantages over prior forms of downhole case driving used with rotary type drills such as the Davey, Sr. device described in U.S. Pat. No. 3,190,378. With the present apparatus, the shoe 26 (unlike the drilling shoes used with rotary drilling apparatus) can be a relatively inexpensive item and can be left at the bottom of the drilled hole without adding significantly to the drilling costs. The shoe 27 is stationary and requires no rotational bearing connection to the casing. Furthermore, the lower casing section 25 situated ahead of the anvil 19 assures fast and efficient removal of drilled material up the casing. The lower section 25 seals off the drilled sections to prevent seepage of fluid (air) into the surrounding strata, leaving the casing as the only escape passage. The drilled material is thus forced up the casing by the upwardly escaping drilling fluid to efficiently cleanse the hole bottom.

It should be understood that various modifications can be made in view of the above description and attached drawings. Additionally, it is conceived that more than two anvil members 20 could be used at angularly spaced positions around the casing, along with an equal number of upright channels 41 and slots 46. Other modifications may also be made that fall within the scope of the following claims.

Having thus described my invention, what I claim is:

1. Apparatus for pulling a well casing downwardly into a drilled hole from a downhole position adjacent the casing bottom end utilizing a drill string having a downhole percussion drill tool at a lower end thereof, comprising:

an anvil affixed to the casing spaced upwardly from the casing bottom end to project inwardly into the casing, defining a lower casing section extending between the anvil and the casing bottom end;

a tubular drive shoe affixed coaxially to the casing bottom end with a central open bore allowing free elevational passage of the drill tool therethrough;

said anvil having an anvil surface within the casing thereon facing upwardly; and percussion drill bit means mountable to the downhole percussion drill tool for normally drilling earth material below the drive shoe with means thereon for selectively engaging the percussion drill bit means with the anvil surface to drive the anvil and casing downwardly with the lower casing section and drive shoe projecting through the drilled earth material forward of the bit means when the percussion drill bit is engaged with the anvil surface.

2. The apparatus as claimed by claim 1 wherein the selective engaging means includes lockout means for selective engagement and disengagement with the anvil surface to drive the anvil and casing downward when the lockout means is in engagement with the anvil surface and to permit the drill bit means to be lowered past the anvil when the lockout means is in disengagement with the anvil surface.

3. The apparatus as claimed in claim 2 wherein the lockout means includes an upright channel formed through the drill bit means that is complementary to and freely slidably receives the anvil surface therein, allowing free elevational passage of the drill bit means past the anvil surface.

4. The apparatus as claimed by claim 3 wherein the drill bit means includes an upright slot angularly disposed from said channel, having an open bottom end for receiving the anvil surface and a closed top end defined by a hammer surface integral with the bit for abutment with the anvil surface.

5. The apparatus as defined by claim 1 wherein the anvil includes:

an open sleeve adapted to coaxially receive and be affixed to the casing; and wherein the anvil surface is integral with said sleeve and includes a ledge surface thereon adapted to engage the casing.

6. The apparatus as claimed by claim 5 wherein the sleeve includes a coaxial downwardly projecting open end for receiving and mounting the lower casing section.

7. The apparatus as claimed by claim 1 wherein the anvil has:

a surface adapted for flush engagement with the exterior of the casing; and an anvil member projecting inward from the shoulder surface with a top surface thereon defining said anvil surface.

8. The apparatus as claimed by claim 7 wherein the anvil is substantially "T" shaped with the anvil member projecting into the interior of the casing and forming the leg of the "T" shape.

9. The apparatus as claimed by claim 4 wherein the upright slot is angularly spaced by 90° about the drill bit means from the upright channel.

10. The apparatus as claimed by claim 1 wherein the anvil is adapted to project through an aperture in the casing at a location adjacent to and upward from the casing bottom end, leaving the lower casing section as an integral part of the casing downward of the anvil shoulder.

* * * * *